US008555672B2

(12) United States Patent
Turner et al.

(10) Patent No.: US 8,555,672 B2
(45) Date of Patent: Oct. 15, 2013

(54) COMPLETE LIQUEFACTION METHODS AND APPARATUS

(75) Inventors: Terry D. Turner, Idaho Falls, ID (US); Bruce M. Wilding, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 931 days.

(21) Appl. No.: 12/603,948

(22) Filed: Oct. 22, 2009

(65) Prior Publication Data

US 2011/0094262 A1 Apr. 28, 2011

(51) Int. Cl.
*F25J 1/00* (2006.01)

(52) U.S. Cl.
USPC ..... 62/613

(58) Field of Classification Search
USPC ..... 62/611–614, 618–620
See application file for complete search history.

(56) References Cited

U.S. PATENT DOCUMENTS

| | | | |
|---|---|---|---|
| 1,222,801 | A | 4/1917 | Rosenbaum |
| 2,037,679 | A | 4/1936 | Dana |
| 2,037,714 | A | 4/1936 | Gaines, Jr. |
| 2,040,059 | A | 5/1936 | Mesinger |
| 2,093,805 | A | 9/1937 | de Baufre |
| 2,157,103 | A | 5/1939 | Zenner |
| 2,209,534 | A | 7/1940 | Moore |
| 2,494,120 | A | 10/1950 | Ferro, Jr. |
| 2,701,641 | A | 2/1955 | Krijgsman |
| 2,858,020 | A | 10/1958 | Bek |
| 2,900,797 | A | 8/1959 | Kurata et al. |
| 2,937,503 | A | 5/1960 | Swearingen et al. |
| 3,132,016 | A | 5/1964 | Kurata |
| 3,168,136 | A | 2/1965 | Ammon |
| 3,182,461 | A | 5/1965 | Johanson |
| 3,193,468 | A | 7/1965 | Sprague |
| 3,213,631 | A | 10/1965 | Kniel |
| 3,218,816 | A | 11/1965 | Grenier |
| 3,236,057 | A | 2/1966 | Hashemi-Tafreshi |
| 3,254,496 | A | 6/1966 | Roche et al. |
| 3,289,756 | A | 12/1966 | Jaeger |
| 3,292,380 | A | 12/1966 | Bucklin |
| 3,312,073 | A | 4/1967 | Jackson et al. |
| 3,315,475 | A | 4/1967 | Harmens |
| 3,323,315 | A | 6/1967 | Carr |

(Continued)

FOREIGN PATENT DOCUMENTS

| | | | |
|---|---|---|---|
| EP | 0 676 599 | A | 10/1995 |
| EP | 1 205 721 | A1 | 5/2002 |

(Continued)

OTHER PUBLICATIONS

U.S. Appl. No. 12/604,139, filed Oct. 22, 2009, titled, "Natural Gas Liquefaction Core Modules, Plants Including Same and Related Methods," by Wilding et al.

(Continued)

*Primary Examiner* — Melvin Jones
(74) *Attorney, Agent, or Firm* — TraskBritt

(57) ABSTRACT

A method and apparatus are described to provide complete gas utilization in the liquefaction operation from a source of gas without return of natural gas to the source thereof from the process and apparatus. The mass flow rate of gas input into the system and apparatus may be substantially equal to the mass flow rate of liquefied product output from the system, such as for storage or use.

22 Claims, 2 Drawing Sheets

(56) References Cited

U.S. PATENT DOCUMENTS 3,326,453 A 6/1967 Kun
3,349,020 A 10/1967 Crownover et al.
3,362,173 A 1/1968 Kneil
3,376,709 A * 4/1968 Dickey et al. ..... 62/637
3,406,496 A 10/1968 Betteridge et al.
3,407,052 A 10/1968 Huntress et al.
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,516,262 A 6/1970 Bernstein
3,548,606 A 12/1970 Kuerston
3,596,473 A 8/1971 Streich
3,608,323 A 9/1971 Salama
3,616,652 A 11/1971 Engel
3,628,340 A 12/1971 Meisler et al.
3,677,019 A 7/1972 Olszewski
3,690,114 A 9/1972 Swearingen et al.
3,724,225 A 4/1973 Mancini et al.
3,724,226 A 4/1973 Pachalay
3,735,600 A 5/1973 Dowdell et al.
3,846,993 A 11/1974 Bates
3,886,885 A 6/1975 Becker et al.
3,897,226 A 7/1975 Doherty
4,001,116 A 1/1977 Selcukoglu
4,004,430 A 1/1977 Solomon et al.
4,007,601 A 2/1977 Webbon
4,022,597 A 5/1977 Bacon
4,025,315 A 5/1977 Mazelli
4,032,337 A 6/1977 Boyer
4,120,911 A 10/1978 Davidson
4,128,410 A 12/1978 Bacon
4,148,723 A 4/1979 Mozley
4,161,107 A 7/1979 Chernychev et al.
4,183,369 A 1/1980 Thomas
4,187,689 A 2/1980 Selcukoglu et al.
4,294,274 A 10/1981 LeRoy
4,318,723 A 3/1982 Holmes et al.
4,334,902 A 6/1982 Paradiwski
4,359,871 A 11/1982 Strass
4,370,150 A 1/1983 Fenstermaker
4,453,956 A 6/1984 Fabbri et al.
4,479,533 A 10/1984 Persson et al.
4,479,536 A 10/1984 Lameris
4,522,636 A 6/1985 Markbreiter et al.
4,528,006 A 7/1985 Vitovec et al.
4,561,496 A 12/1985 Kehrer
4,609,390 A 9/1986 Wilson
4,611,655 A 9/1986 Molignoni
4,654,522 A 3/1987 Gornick et al.
4,783,272 A 11/1988 Patterson
4,798,242 A 1/1989 Kito et al.
4,822,393 A 4/1989 Markbreiter et al.
4,846,862 A 7/1989 Cook
4,869,313 A 9/1989 Fredley
4,970,867 A 11/1990 Harron et al.
4,993,485 A 2/1991 Gorman
4,994,097 A 2/1991 Brouwers
5,003,782 A 4/1991 Kucerija
5,032,143 A 7/1991 Ritakallio
5,036,671 A 8/1991 Nelson et al.
5,062,270 A * 11/1991 Haut et al. ..... 62/629
5,174,796 A 12/1992 Davis et al.
5,218,832 A 6/1993 Woolley
5,252,613 A 10/1993 Chang et al.
5,291,736 A 3/1994 Paradowski
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,473,900 A 12/1995 Low
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,669,234 A 9/1997 Houser et al.
5,704,227 A 1/1998 Krabbendam
5,718,126 A 2/1998 Capron et al.
5,755,114 A 5/1998 Foglietta
5,755,280 A 5/1998 Da Costa et al.
5,799,505 A 9/1998 Bonaquist et al.
5,819,555 A 10/1998 Engdahl
5,836,173 A 11/1998 Lynch et al.
5,916,260 A 6/1999 Dubar
5,950,453 A 9/1999 Bowen et al.
5,956,971 A 9/1999 Cole et al.
5,983,665 A 11/1999 Howard et al.
6,023,944 A 2/2000 Blundell
6,041,620 A 3/2000 Olszewski et al.
6,085,546 A 7/2000 Johnston
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 4/2001 Hass et al.
6,250,244 B1 6/2001 Dubar et al.
6,301,927 B1 10/2001 Reddy
6,354,105 B1 3/2002 Lee et al.
6,367,286 B1 4/2002 Price
6,370,910 B1 4/2002 Grootjans et al.
6,372,019 B1 4/2002 Alferov et al.
6,375,906 B1 4/2002 Edlund et al.
6,378,330 B1 4/2002 Minta et al.
6,382,310 B1 5/2002 Smith
6,389,844 B1 5/2002 Klein Nagel Voort
6,390,114 B1 5/2002 Haandrikman et al.
6,397,936 B1 6/2002 Crowley et al.
6,400,896 B1 6/2002 Longardner
6,410,087 B1 6/2002 Wilde et al.
6,412,302 B1 7/2002 Foglietta
6,425,263 B1 7/2002 Bingham et al.
6,427,464 B1 8/2002 Beaverson et al.
6,442,969 B1 9/2002 Rojey et al.
6,484,533 B1 11/2002 Allam et al.
6,581,409 B2 6/2003 Wilding et al.
6,581,510 B2 6/2003 Koch et al.
6,694,774 B1 2/2004 Rashad et al.
6,722,399 B1 4/2004 Cano
6,742,358 B2 6/2004 Wilkinson et al.
6,767,388 B2 7/2004 Lecomte et al.
6,962,061 B2 11/2005 Wilding et al.
7,219,512 B1 5/2007 Wilding et al.
7,228,714 B2 6/2007 Howard
7,325,415 B2 2/2008 Amin et al.
7,469,556 B2 12/2008 Howard
7,575,624 B2 8/2009 Cartwright et al.
7,591,150 B2 9/2009 Turner et al.
7,594,414 B2 9/2009 Wilding et al.
7,765,920 B2 8/2010 Keller
8,245,727 B2 8/2012 Mooney et al.
8,250,883 B2 8/2012 Migliore et al.
2003/0196452 A1 10/2003 Wilding et al.
2004/0083888 A1 5/2004 Qualls
2004/0105812 A1 6/2004 Tonkovich et al.
2004/0148962 A1 8/2004 Rashad et al.
2004/0177646 A1 9/2004 Wilkinson et al.
2005/0144979 A1 7/2005 Zollinger et al.
2005/0183452 A1 8/2005 Hahn et al.

(56) References Cited

U.S. PATENT DOCUMENTS

| | | | |
|---|---|---|---|
| 2005/0220704 | A1 | 10/2005 | Morrow et al. |
| 2005/0279132 | A1 | 12/2005 | Eaton et al. |
| 2006/0053806 | A1 | 3/2006 | Tassel |
| 2006/0213222 | A1 | 9/2006 | Whitesell |
| 2007/0017250 | A1 | 1/2007 | Turner |
| 2007/0107465 | A1 | 5/2007 | Turner et al. |
| 2007/0137246 | A1 | 6/2007 | McKellar et al. |
| 2007/0193303 | A1 | 8/2007 | Hawrysz et al. |
| 2008/0156035 | A1 | 7/2008 | Aspelund et al. |
| 2009/0071634 | A1 | 3/2009 | Turner et al. |
| 2010/0018248 | A1 | 1/2010 | Fieler et al. |
| 2010/0088920 | A1 | 4/2010 | LaRou |
| 2010/0186446 | A1 | 7/2010 | Turner et al. |
| 2010/0223950 | A1 | 9/2010 | Malsam |
| 2010/0313597 | A1 | 12/2010 | Bridgwood |
| 2012/0103012 | A1 | 5/2012 | Turner et al. |
| 2012/0103428 | A1 | 5/2012 | Turner et al. |
| 2012/0103561 | A1 | 5/2012 | Turner et al. |

FOREIGN PATENT DOCUMENTS

| | | | |
|---|---|---|---|
| JP | 58-159830 | | 9/1983 |
| JP | 11200817 | A | 7/1999 |
| JP | 2002071861 | A | 3/2002 |
| WO | 88/00936 | | 2/1988 |
| WO | 98/59206 | | 12/1998 |
| WO | 03/062725 | A | 7/2003 |
| WO | 2010023238 | A1 | 3/2010 |

OTHER PUBLICATIONS

U.S. Appl. No. 12/604,194, filed Oct. 22, 2009, titled, "Methods of Natural Gas Liquefaction and Natural Gas Liquefaction Plants Utilizing Multiple and Varying Gas Streams," by Wilding et al.
PCT International Preliminary Report on Patentability and Written Opinion for PCT/US2010/045321 dated Oct. 1, 2010, 6 pages.
PCT International Search Report and Written Opinion for PCT/US2010/045340 dated Oct. 13, 2010, 9 pages.
PCT International Preliminary Report on Patentability and Written Opinion for PCT/US2010/045332 dated Oct. 18, 2010, 11 pages
Search Report for PCT/US2006/041039 dated Aug. 8, 2007.
Search Report for PCT/US2007/084677 dated Jul. 1, 2008.
International Preliminary Report for PCT/US08/68938 dated Mar. 16, 2010.
Search Report for PCT/US2010/045340 dated Oct. 13, 2010.
Search Report for PCT/US2010/045332 dated Oct. 18, 2010.
Search Report for PCT/US2008/051012 dated May 20, 2008.
Search Report for PCT/US2010/045321 dated Oct. 1, 2010.
International Preliminary Examination Report for PCT/US2002/20924 dated Jun. 17, 2003.
Search Report for PCT/US1998/027232, dated Jul. 7, 1999.
Bodner Research Web, "Phase Diagrams," http://chemed.chem.purdue.edu/genchem/topicreview/bp/ch14/phase.php.
"A National Vision of America's Transition to a Hydrogen Economy—to 2030 and Beyond," Based on the results of the National Hydrogen Vision Meeting Washington, DC Nov. 15-16, 2001, United States Department of Energy.
Curtin University of Technology, LNG Microcell Progress Update, May 2002, Curtin/Corelab.
"Generation of Hydrogen and Transportation and Transmission of Energy Generated on the U.S. Outer Continental Shelf to Onshore," (Minerals Management Service), May 2006.
Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, pp. 1-15.
"Hydrogen as an Energy Carrier and its Production by Nuclear Power," IAEA-TECDOC-1085, International Atomic Energy Agency, May 1999.
"Hydrogen Infrastructure Delivery, Reliability R&D Needs," Science Applications International Corporation, Prepared for U.S. Department of Energy, NETL Natural Gas & Infrastructure Reliability Program <www.netl.doe.gov/technologies/oil-gas/publications/td/Final%20White%20Paper%20072604.pdf>.
International Search Report dated Sep. 17, 2002 (4 pages).
Mott Corporation, "Porous metal solutions," Jun. 2007, 16 pages.
"Porous Metal Design Guidebook," Metal Powder Industries Federation, Princeton, NJ, <<http://www.mpif.org/designcenter/porous.pdf>>, Jun. 2007, 25 pages.
"The Hydrogen Economy: Opportunities, Costs, Barriers, and R&D Needs," National Academy of Engineering and Board on Energy and Environmental Systems, 2004, The National Academies Press, <http://books.nap.edu/books/0309091632/html/index.html>.
"The Hydrogen Initiative, Panel on Public Affairs," American Physical Society, Mar. 2004, <http://www.aps.org/public_affairs/popa/reports/index.cfm>.
PCT International Preliminary Report on Patentability and Written Opinion for PCT/US2006/041039 dated Apr. 9, 2009, 7 pages.
PCT International Preliminary Report on Patentability and Written Opinion for PCT/US2007/084677 dated May 28, 2009, 7 pages.
PCT International Search Report and Written Opinion for PCT/US08/68938 dated Oct. 10, 2008, 8 pages.
PCT International Preliminary Report on Patentability and Written Opinion for PCT/US2008/051012 dated Aug. 27, 2009, 7 pages.

* cited by examiner

COMPLETE LIQUEFACTION METHODS AND APPARATUS

GOVERNMENT RIGHTS

This invention was made with government support under Contract Number DE-AC07-05ID14517 awarded by the United States Department of Energy. The government has certain rights in the invention.

CROSS-REFERENCE TO RELATED APPLICATIONS

This application is related to U.S. patent application Ser. No. 09/643,420, filed Aug. 23, 2001, for APPARATUS AND PROCESS FOR THE REFRIGERATION, LIQUEFACTION AND SEPARATION OF GASES WITH VARYING LEVELS OF PURITY, now U.S. Pat. No. 6,425,263, issued Jul. 30, 2002, which is a continuation of U.S. patent application Ser. No. 09/212,490, filed Dec. 16, 1998, for APPARATUS AND PROCESS FOR THE REFRIGERATION, LIQUEFACTION AND SEPARATION OF GASES WITH VARYING LEVELS OF PURITY, now U.S. Pat. No. 6,105,390, issued Aug. 22, 2000, which claims the benefit of U.S. Provisional Patent Application Ser. No. 60/069,698, filed Dec. 16, 1997. This application is also related to U.S. patent application Ser. No. 11/381,904, filed May 5, 2006, for APPARATUS FOR THE LIQUEFACTION OF NATURAL GAS AND METHODS RELATING TO SAME, now U.S. Pat. No. 7,594,414, issued Sep. 29, 2009; U.S. patent application Ser. No. 11/383,411, filed May 15, 2006, for APPARATUS FOR THE LIQUEFACTION OF NATURAL GAS AND METHODS RELATING TO SAME, now U.S. Pat. No. 7,591,150, issued Sep. 22, 2009; U.S. patent application Ser. No. 11/560,682, filed Nov. 16, 2006, for APPARATUS FOR THE LIQUEFACTION OF GAS AND METHODS RELATING TO SAME; U.S. patent application Ser. No. 11/536,477, filed Sep. 28, 2006, for APPARATUS FOR THE LIQUEFACTION OF A GAS AND METHODS RELATING TO SAME, now U.S. Pat. No. 7,637,122, issued Dec. 29, 2009; U.S. patent application Ser. No. 11/674,984, filed Feb. 14, 2007, for SYSTEMS AND METHODS FOR DELIVERING HYDROGEN AND SEPARATION OF HYDROGEN FROM A CARRIER MEDIUM, now abandoned, which is a continuation-in-part of U.S. patent application Ser. No. 11/124,589 filed on May 5, 2005, for APPARATUS FOR THE LIQUEFACTION OF NATURAL GAS AND METHODS RELATING TO SAME, now U.S. Pat. No. 7,219,512, issued May 22, 2007, which is a continuation of U.S. patent application Ser. No. 10/414,991 filed on Apr. 14, 2003, for APPARATUS FOR THE LIQUEFACTION OF NATURAL GAS AND METHODS RELATING TO SAME, now U.S. Pat. No. 6,962,061 issued on Nov. 8, 2005, and U.S. patent application Ser. No. 10/414,883, filed Apr. 14, 2003, for APPARATUS FOR THE LIQUEFACTION OF NATURAL GAS AND METHODS RELATING TO SAME, now U.S. Pat. No. 6,886,362, issued May 3, 2005, which is a divisional of U.S. patent application Ser. No. 10/086,066 filed on Feb. 27, 2002, for APPARATUS FOR THE LIQUEFACTION OF NATURAL GAS AND METHODS RELATED TO SAME, now U.S. Pat. No. 6,581,409 issued on Jun. 24, 2003, and which claims the benefit of U.S. Provisional Patent Application Ser. No. 60/288,985, filed May 4, 2001, for SMALL SCALE NATURAL GAS LIQUEFACTION PLANT. This application is also related to U.S. patent application Ser. No. 11/855,071, filed Sep. 13, 2007, for HEAT EXCHANGER AND ASSOCIATED METHODS, now U.S. Pat. No. 8,061,413, issued Nov. 22, 2011; U.S. patent application Ser. No. 12/604,194, filed on even date herewith, for METHODS OF NATURAL GAS LIQUEFACTION AND NATURAL GAS LIQUEFACTION PLANTS UTILIZING MULTIPLE AND VARYING GAS STREAMS; and U.S. patent application Ser. No. 12/604,139, filed on even date herewith, for NATURAL GAS LIQUEFACTION CORE MODULES, PLANTS INCLUDING SAME AND RELATED METHODS. The disclosure of each of the foregoing documents is incorporated herein in its entirety by reference. This application is also related to U.S. patent application Ser. No. 12/938,761, filed Nov. 3, 2010, for VAPORIZATION CHAMBERS AND ASSOCIATED METHODS; U.S. patent application Ser. No. 12/938,826, filed Nov. 3, 2010, for HEAT EXCHANGER AND RELATED METHODS; U.S. patent application Ser. No. 12/938,967, filed Nov. 3, 2010, for SUBLIMATION SYSTEMS AND ASSOCIATED METHODS; and U.S. patent application Ser. No. 13/528,246, filed Jun. 20, 2012, for NATURAL GAS LIQUEFACTION EMPLOYING INDEPENDENT REFRIGERANT PATH.

TECHNICAL FIELD

The present invention relates generally to the compression and liquefaction of gases and, more particularly, to the complete liquefaction of a gas, such as natural gas, by utilizing a combined refrigerant and expansion process in situations where natural gas cannot or is not desired to be returned from the liquefaction process to the source thereof or another apparatus for collection.

BACKGROUND

Natural gas is a known alternative to combustion fuels such as gasoline and diesel. Much effort has gone into the development of natural gas as an alternative combustion fuel in order to combat various drawbacks of gasoline and diesel, including production costs and the subsequent emissions created by the use thereof. As is known in the art, natural gas is a cleaner burning fuel than other combustion fuels. Additionally, natural gas is considered to be safer than gasoline or diesel, as natural gas will rise in the atmosphere and dissipate, rather than settling.

To be used as an alternative combustion fuel, natural gas is conventionally converted into compressed natural gas (CNG) or liquified (or liquid) natural gas (LNG) for purposes of storing and transporting the fuel prior to its use. Conventionally, two of the known basic cycles for the liquefaction of natural gases are referred to as the "cascade cycle" and the "expansion cycle."

Briefly, the cascade cycle consists of a series of heat exchanges with the feed gas, each exchange being at successively lower temperatures until the desired liquefaction is accomplished. The levels of refrigeration are obtained with different refrigerants or with the same refrigerant at different evaporating pressures. The cascade cycle is considered to be very efficient at producing LNG, as operating costs are relatively low. However, the efficiency in operation is often seen to be offset by the relatively high investment costs associated with the expensive heat exchange and the compression equipment associated with the refrigerant system. Additionally, a liquefaction plant incorporating such a system may be impractical where physical space is limited, as the physical components used in cascading systems are relatively large.

In an expansion cycle, gas is conventionally compressed to a selected pressure, cooled and then allowed to expand through an expansion turbine, thereby producing work as well as reducing the temperature of the feed gas. The low temperature feed gas is then heat exchanged to effect liquefaction of the feed gas. Conventionally, such a cycle has been seen as being impracticable in the liquefaction of natural gas since there is no provision for handling some of the components present in natural gas that freeze at the temperatures encountered in the heat exchangers, for example, water and carbon dioxide.

Additionally, to make the operation of conventional systems cost effective, such systems are conventionally built on a large scale to handle large volumes of natural gas. As a result, fewer facilities are built making it more difficult to provide the raw gas to the liquefaction plant or facility as well as making distribution of the liquefied product an issue. Another major problem with large-scale facilities is the capital and operating expenses associated therewith. For example, a conventional large-scale liquefaction plant, i.e., producing on the order of 70,000 gallons of LNG per day, may cost $16.3 million to $24.5 million, or more, in capital expenses.

An additional problem with large facilities is the cost associated with storing large amounts of fuel in anticipation of future use and/or transportation. Not only is there a cost associated with building large storage facilities, but there is also an efficiency issue related therewith as stored LNG will tend to warm and vaporize over time creating a loss of the LNG from storage. Further, safety may become an issue when larger amounts of LNG fuel product are stored.

In view of the shortcomings in the art, it would be advantageous to provide a process, and a plant for carrying out such a process, of efficiently producing liquefied natural gas on a relatively small scale. More particularly, it would be advantageous to provide a system for producing liquefied natural gas from a source after the removal of components thereof.

It would be additionally advantageous to provide a plant for the liquefaction of natural gas that is relatively inexpensive to build and operate, and that desirably requires little or no operator oversight.

It would be additionally advantageous to provide such a plant that is easily transportable and that may be located and operated at existing sources of natural gas that are within or near populated communities, thus providing easy access for consumers of LNG fuel.

Because there has been significant interest in liquefying natural gas recently, most technologies have focused on small-scale liquefaction where only a small portion of the incoming gas is liquefied with the majority of the incoming gas being returned to the infrastructure and source of the gas. These technologies work well in areas with established pipeline infrastructure for the return of gas from the small-scale liquefaction unit. Such small-scale units can be very cost effective, with liquefaction efficiencies significantly surpassing any full-scale production plant. Since the small-scale liquefaction units have a small footprint using little space, they are desirable for use with distributed gas supply systems. Also, small-scale liquefaction units typically have initial low capitol cost and low maintenance costs making it easier for such units to be purchased and operated.

Some locations do not have the benefit of a pipeline infrastructure, but still produce natural gas. Examples of types of such locations are waste disposal sites and coal bed methane wells, which typically produce enough natural gas to consider capturing and selling the gas in a convenient form. When the operators of waste disposal sites capture gas from the site, they can either use the gas for fuel of their equipment, or sell the fuel for other uses, thereby reducing costs of the waste disposal site. Coal bed methane wells can be productive over lengthy periods and the gas sold or used in onsite equipment.

However, without the ability to return natural gas to its source or an equivalent thereof, such as natural gas piping infrastructure, a conventional small-scale liquefaction unit is not feasible to use for natural gas liquefaction. Therefore, a compact natural gas liquefaction process and unit is needed that will provide complete liquefaction of the natural gas entering the process and unit. That is, 100% of the natural gas entering the process and unit or substantially all of the natural gas entering the process and unit may exit the unit as liquefied natural gas. If a small-scale complete liquefaction natural gas process and unit cannot be provided, it may not be feasible to liquefy natural gas from waste disposal sites and coal bed methane wells because conventional small-scale liquefaction processes and units require the return of un-liquefied natural gas from the unit to a pipeline infrastructure or other suitable receiving reservoir.

Complete liquefaction has long been the domain of large, capital intensive LNG plants, making it difficult for small natural gas markets to be conveniently supplied with natural gas. The use of complete liquefaction processes and apparatus as described herein facilitates liquefaction of natural gas at waste disposal sites, coal bed methane wells, and other types of single source supplies of natural gas where gas cannot be returned from the liquefaction process and apparatus. Other such instances where the use of the complete liquefaction process and unit described herein includes the liquefaction of natural gas from a pipeline where it is not desirable to return a large volume of natural gas from the liquefaction process and unit back into a pipeline because either the volume of natural gas to be returned to the pipeline is too great, or the pressure of the natural gas being returned to the pipeline is too great, or regulations prevent the return of natural gas from the conventional liquefaction process and unit to the pipeline, or policies prohibit the return of natural gas from the conventional liquefaction process and unit to a pipeline. The complete liquefaction processes and apparatus described herein facilitate the production of natural gas and the transportation thereof at locations previously considered to be unattractive for the production of natural gas.

BRIEF SUMMARY

A method and apparatus are described that may provide complete gas utilization in the liquefaction operation from a source of gas without return of natural gas to the source thereof from the process and apparatus. The mass flow rate of gas input into the system and apparatus may be substantially equal to the mass flow rate of liquefied product output from the system, such as for storage or use.

In some embodiments, a liquefaction plant having an inlet connected to a source of gas may include a first mixer connected to the source of gas, a first compressor for receiving a stream of gas from the first mixer for producing a compressed gas stream, a first splitter for splitting the compressed gas stream from the first compressor into a cooling stream and a process stream, and a turbo compressor for compressing the cooling stream from the first splitter. The liquefaction plant may further include a heat exchanger for cooling the process stream into a liquid and a gas vapor, a separation tank for separating the gas vapor from the liquid of the process stream, and a storage tank connected to the separation tank for storing the liquid. Additionally, the liquefaction plant may include an apparatus connecting the separation tank to the first mixer, and an apparatus connecting the storage tank to the first mixer.

In additional embodiments, a method of liquefying natural gas from a source of gas using a liquefaction plant having an inlet for gas may include connecting a first mixer to the source of gas, and compressing a first stream of natural gas from the first mixer for producing a compressed gas stream. The method may further include splitting the process stream using a first splitter into a cooling stream and a process stream, compressing the cooling stream using a turbo expander, expanding the compressed cooling stream using a turbo expander, and cooling the process stream with a heat exchanger. Additionally, the method may include separating vapor from the liquid gas in a separation tank, storing liquid natural gas in a storage tank, flowing vapor from the separation tank and vapor from the storage tank into the first mixer to mix with gas from the source of gas, forming gas from liquid natural gas in the separation vessel using the heat exchanger, and flowing gas from the heat exchanger to the first mixer to mix with gas from the source of gas.

In yet additional embodiments, a method of liquefying gas from a source of gas using a liquefaction plant having an inlet for gas may include connecting a first mixer to the source of gas, compressing a first stream of gas from the first mixer for producing a process stream, and splitting the process stream using a first splitter into a cooling stream and a process stream. The method may further include compressing the cooling stream using a turbo compressor, expanding the compressed cooling stream using a turbo expander, cooling the process stream in a heat exchanger, and expanding the process stream to further cool the process stream. Also, the method may include directing the process stream into a separation vessel to separate a liquid and a vapor, storing the liquid in a storage tank, and flowing the vapor from the separation vessel and a vapor from the storage vessel into the first mixer to mix with gas from the source of gas. Additionally, the method may include vaporizing a portion of the liquid from the separation tank using the heat exchanger, and flowing gas from the heat exchanger to the first mixer to mix with gas from the source of gas.

BRIEF DESCRIPTION OF THE DRAWINGS

The foregoing and other advantages of the invention will become apparent upon reading the following detailed description and upon reference to the drawings.

DETAILED DESCRIPTION OF THE INVENTION

Figure 1:
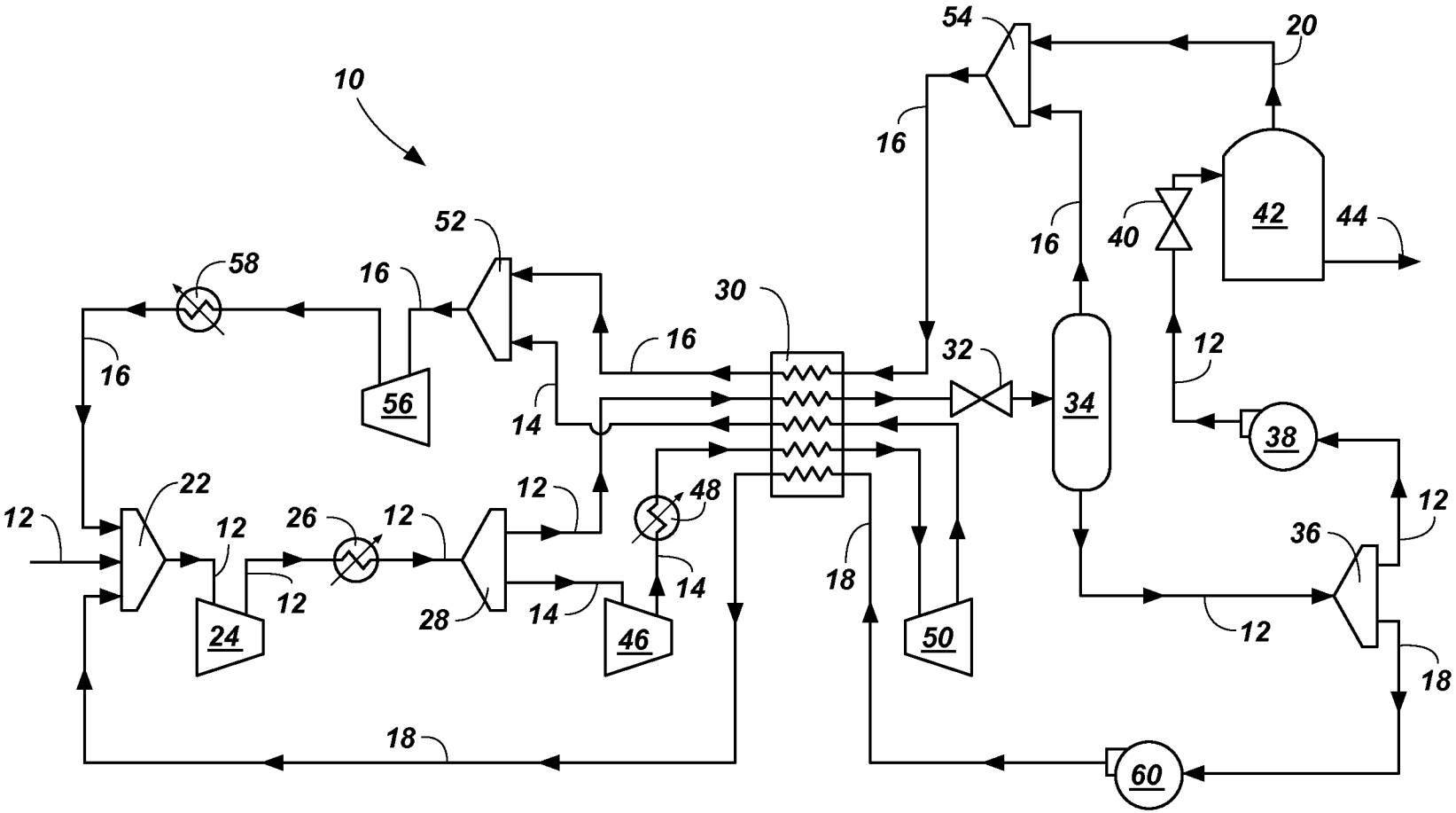
FIG. 1 is a process flow diagram for a liquefaction plant according to an embodiment of the present invention.

Illustrated in FIG. 1 is a schematic overview of a plant 10 for natural gas (NG) liquefaction according to an embodiment of the present invention. The plant 10 may include a process stream 12, a cooling stream 14, return streams 16, 18 and a vent stream 20. As shown in FIG. 1, the process stream 12 may be directed into a mixer 22 and then through a compressor 24. Upon exiting the compressor 24, the process stream 12 may be directed through a heat exchanger 26 and then through a splitter 28. The process stream 12 may exit an outlet of the splitter 28 and then be directed through a primary heat exchanger 30 and an expansion valve 32. The process stream 12 may then be directed though a gas-liquid separation tank 34. Finally, the process stream 12 may be directed through a splitter 36, a pump 38, a valve 40, a storage tank 42 and a liquid natural gas (LNG) outlet 44.

As further shown in FIG. 1, the cooling stream 14 may be directed from the splitter 28 through a turbo compressor 46, an ambient heat exchanger 48, the primary heat exchanger 30, a turbo expander 50, and finally, redirected through the primary heat exchanger 30 and into the mixer 52.

A first return stream 16 may include a combination of streams 14, 18, 20 from the plant 10. For example, as shown in FIG. 1, the first return stream 16 may originate from the gas-liquid separation chamber 34 and be directed into a mixer 54 where it may be combined with the vent stream 20 from the storage tank 42. The first return stream 16 may then be directed from the mixer 54 through the primary heat exchanger 30. Upon exiting the primary heat exchanger 30, the first return stream 16 may be directed into the mixer 52, where it may be combined with the cooling stream 14. The first return stream 16 may then be directed out of the mixer 52 and through a compressor 56. After exiting the compressor 56, the first return stream 16 may be directed through a heat exchanger 58, and finally, into the mixer 22.

Finally, as shown in FIG. 1, a second return stream 18 may be directed from an outlet of the splitter 36. The second return stream 18 may then be directed through a pump 60, the primary heat exchanger 30, and finally, into the mixer 22.

In operation, a process stream 12 comprising a gaseous natural gas (NG) may be provided to the plant 10 through an inlet into the mixer 22. In some embodiments, the process stream 12 may then be compressed to a higher pressure level with the compressor 24, such as a turbo compressor, and may also become heated within the compressor 24. Upon exiting the compressor 24, the process stream 12 may be directed through the heat exchanger 26 and may be cooled. For example, the heat exchanger 26 may be utilized to transfer heat from the cooling stream to ambient air. After being cooled with the heat exchanger 26, the process stream 12 may be directed into the splitter 28, where a portion of the process stream 12 may be utilized to provide the cooling stream 14. In additional embodiments, a process stream 12 comprising a gaseous NG may be provided to the plant 10 through an inlet into the mixer 22 at a sufficient pressure that the compressor 24 and the heat exchanger 26 may not be required and may not be included in the plant 10.

The cooling stream 14 may be directed from the splitter 28 into the turbo compressor 46 to be compressed. The compressed cooling stream 14 may then exit the turbo compressor 46 and be directed into the heat exchanger 58, which may transfer heat from the compressed cooling stream 14 to ambient air. Additionally, the compressed cooling stream 14 may be directed through a first channel of the primary heat exchanger 30, where it may be further cooled.

In some embodiments, the primary heat exchanger 30 may comprise a high performance aluminum multi-pass plate and fin-type heat exchanger, such as may be purchased from Chart Industries Inc., 1 Infinity Corporate Centre Drive, Suite 300, Garfield, Heights, Ohio 44125, USA, or other well-known manufacturers of such equipment.

After passing through the primary heat exchanger 30, the cooling stream 14 may be expanded and cooled in the turbo expander 50. For example, the turbo expander 50 may comprise a turbo expander having a specific design for a mass flow rate, pressure level of gas, and temperature of gas to the inlet, such as may be purchased from GE Oil and Gas, 1333 West Loop South, Houston, Tex. 77027-9116, USA, or other well-known manufacturers of such equipment. Additionally, the energy required to drive the turbo compressor 46 may be provided by the turbo expander 50, such as by the turbo expander 50 being directly connected to the turbo compressor 46 or by the turbo expander 50 driving an electrical generator (not shown) to produce electrical energy to drive an electrical motor (not shown) that may be connected to the turbo compressor 46. The cooled cooling stream 14 may then be directed through a second channel of the primary heat exchanger 30 and then into the mixer 52 to be combined with the first return stream 16.

Meanwhile, the process stream 12 may be directed from the splitter 28 through a third channel of the primary heat exchanger 30. Heat from the process stream 12 may be transferred to the cooling stream 14 within the primary heat exchanger 30 and the process stream 12 may exit the primary heat exchanger 30 in a cooled gaseous state. The process stream 12 may then be directed through the expansion valve 32, such as a Joule-Thomson expansion valve, wherein the process stream 12 may be expanded and cooled to form a liquid natural gas (LNG) portion and a gaseous NG portion that may be directed into the gas-liquid separation chamber 34. The gaseous NG and the LNG may be separated in the gas-liquid separation chamber 34 and the process stream 12 exiting the gas-liquid separation chamber 34 may be an LNG process stream 12. The process stream 12 may then be directed into the splitter 36. From the splitter 36 a portion of the LNG process stream 12 may provide the return stream 18. In some embodiments, the remainder of the LNG process stream 12 may be directed through the pump 38, then through the valve 40, which may be utilized to regulate the pressure of the LNG process stream 12, and then into the storage tank 42, wherein it may be withdrawn for use through the LNG outlet 44, such as to a vehicle that is powered by LNG or into a transport vehicle.

The gaseous NG from the gas-liquid separation chamber 34 may be directed out of the gas-liquid separation chamber 34 in the first return stream 16. The first return stream 16 may then be directed into the mixer 54 where it may be combined with the vent gas stream 20 from the storage tank 42. The first return stream 16 may be relatively cool upon exiting the mixer 54 and may be directed through a fourth channel of the primary heat exchanger 30 to extract heat from the process stream 12 in the third channel of the primary heat exchanger 30. The first return stream 16 may then be directed mixer 52, where it may be combined with the cooling stream 14. The first return stream 16 may then be compressed to a higher pressure level with the compressor 56, such as a turbo compressor, and incidentally may also become heated within the compressor 56. A power source (not shown) for the compressors 24, 46, 56 may be any suitable power source, such as an electric motor, an internal combustion engine, a gas turbine engine, such as powered by natural gas, etc.

Upon exiting the compressor 56, the first return stream 16 may be directed through the heat exchanger 58 and may be cooled. For example, the heat exchanger 58 may be utilized to transfer heat from the first return stream 16 to ambient air. After being cooled with the heat exchanger 58, the first return stream 16 may be directed into the mixer 22.

Finally, the second return stream 18, which may originate as LNG from the splitter 36, may be directed through a fifth channel of the primary heat exchanger 30, where the second return stream 18 may extract heat from the process stream 12, and the second return stream 18 may become vaporized to form gaseous NG. The second return stream 18 may then be directed into the mixer 22, where it may be combined with the first return stream 16 and the process stream 12 entering the plant 10. In some embodiments, the second return stream 18 may be directed through the pump 60 upon exiting the splitter 36. In additional embodiments, a pump (not shown) may be located between the gas-liquid separation chamber 34 and the splitter 36 and the pump 60 may not be required and may not be included in the plant 10. Furthermore, if a pump (not shown) is included that is located between the gas-liquid separation chamber 34 and the splitter 36, the pump 38 may not be included in the plant 10 and the valve 40 may be utilized to regulate the pressure of the LNG process stream 12 directed to the storage tank 42, thus reducing the number of pumps included in the plant 10.

Figure 2:
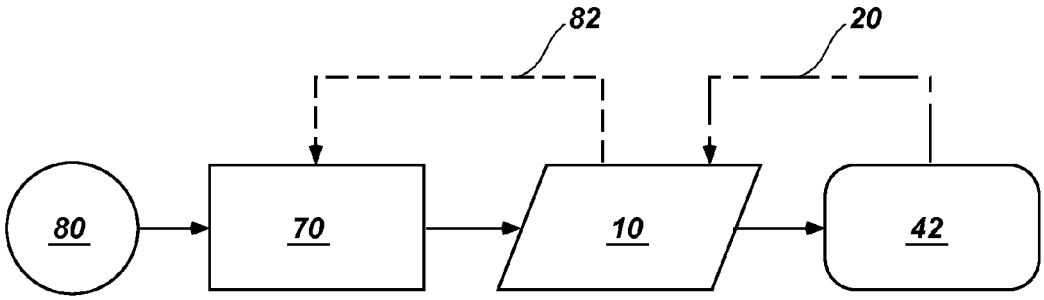
FIG. 2 is a schematic overview of a gas source, a liquefaction plant and an LNG storage, according to an embodiment of the present invention.

As shown in FIG. 2, an LNG liquefaction plant 10 may be coupled to a clean-up unit 70 that may be coupled to a gas source 80. The clean-up unit 70 may separate, such as by filtration, impurities from the natural gas (NG) before the liquefaction of the gas within the plant 10. For example, the gas source 80 may be a waste disposal site that may contain a number of gases not conducive to transportation fuel and a liquefaction process. Such gases may include water, carbon dioxide, nitrogen, siloxanes, etc. Additionally, the gas from the gas source 80 may be pressurized prior to being directed into the plant 10. Conventional methods and apparatus for such cleaning and pressurization may be utilized.

The gas source 80 may be a gas supply such as a waste disposal site, coal bed methane well, or natural gas pipeline, or any source of gas where a portion of the gas therefrom that has not been liquefied cannot be returned to the source. The gas from the gas source 80 may be fed into the clean-up unit 70, which may contain a number of components for cleaning the gas and optionally for pressurization of the gas during such cleaning. After cleaning the gas, the pressure of the clean gas may be increased to a suitable level for the plant 10. Additionally, depending on the pressure of the gas from the gas source 80, it may be necessary to compress the gas prior to the cleaning the gas. For example, gas from a waste disposal site typically has a pressure of approximately atmospheric pressure requiring using a compressor to increase the pressure of the gas before any cleaning of the gas. By using a compressor to increase the pressure of the gas before cleaning of the gas from a waste disposal site, compression of the gas after cleaning may not be required. However, in many situations the use of a compressor to increase the pressure of the gas both before and after cleaning of the gas may be required.

As shown in FIG. 2, an optional gas return 82 may be provided to return gases from the plant 10 to the clean-up unit 70 for additional cleaning of the gas. For example, gases, such as nitrogen, may build-up over time and need to be returned to be removed from the gas. Additionally, a vent stream 20 may be directed back into the plant 10 from the storage tank 42, as previously described with reference to FIG. 1 herein.

Example

In one embodiment, the process stream 12 may be provided to the plant 10 at a pressure level of approximately 300 psia, a temperature level of approximately 100° F., and at a mass flow rate of approximately 1000 lbm/hr. The incoming process stream 12 may then mixed in the mixer 22 with the return streams 16, 18, creating a process stream 12 exiting the mixer 22 having a flow rate of approximately 6350 lbm/hr, at a pressure level of approximately 300 psia, and a temperature level of approximately 97° F. The process stream 12 may then be compressed by the compressor 24 to a pressure level of approximately 750 psia and cooled by ambient air to a temperature level of approximately 100° F. with the heat exchanger 26 prior to being directed into the splitter 28. About fifty-seven (57%) percent of the total mass flow may be directed into the cooling stream 14 and the remaining about forty-three (43%) percent of the mass flow may be directed into the process stream 12 exiting the splitter 28. The process stream 12 may be cooled to a temperature level of approximately −190° F. within the primary heat exchanger 30 and may exit the primary heat exchanger 30 at a pressure level of approximately 750 psia. The process stream 12 may then be further cooled by the expansion valve 32 to approximately −237° F. at a pressure of approximately 35 psia, which may result in a process stream 12 comprised of about 21% vapor and about 79% liquid. This example may provide a plant 10 and method of liquefaction that enables the liquefaction of 1000 lbm/hr, an amount equal to the input into the plant 10.

As may be readily apparent from the foregoing, the process and plant 10 as described herein may recycle a portion of the gas in the process and plant 10 to liquefy an amount of gas for storage or use that is equal to the mass flow into the process and plant 10. In this manner, the process and plant 10 can be used for liquefaction of gas where gas cannot be returned to the source thereof such as described herein. For example, the plant 10 may be utilized for waste disposal sites, coal bed methane wells, and off-shore wells.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the scope of the invention as defined by the following appended claims.

What is claimed is:

1. A liquefaction plant configured to have an inlet connected to a source of gas, the liquefaction plant comprising:
- a first mixer connected to the inlet;
- a first splitter for splitting a gas stream from the first mixer into a cooling stream and a process stream;
- a first compressor for compressing the cooling stream from the first splitter;
- a heat exchanger for cooling the process stream into a liquid and a gas vapor;
- a separation tank for separating the gas vapor from the liquid of the process stream;
- a storage tank connected to a liquid outlet of the separation tank for storing the liquid;
- an apparatus connecting a vapor outlet of the separation tank to the first mixer; and
- an apparatus connecting a vapor outlet of the storage tank to the first mixer.

2. The liquefaction plant of claim 1, further comprising:
- an expander coupled to the compressor for expanding the cooling stream;
- an expansion valve for expanding the process stream after the heat exchanger; and
- a second compressor for compressing at least a portion of a vapor from the storage tank and a portion of a vapor from the separation tank.

3. The liquefaction plant of claim 2, further comprising a third compressor for compressing the gas stream from the first mixer, prior to the first splitter.

4. The liquefaction plant of claim 3, further comprising an outlet of the second compressor connected to the first mixer.

5. The liquefaction plant of claim 1, further comprising a gas clean up unit for removing at least one of water, $CO_2$, and nitrogen from the gas.

6. The liquefaction plant of claim 1, further comprising an outlet of the separation tank connected to the storage tank through a pump.

7. The liquefaction plant of claim 1, further comprising a second mixer connected to the separation tank and to the storage tank.

8. The liquefaction plant of claim 7, further comprising a third mixer having an inlet thereof connected to the second mixer and an outlet thereof connected to the first mixer.

9. The liquefaction plant of claim 1, further comprising a second splitter connected to a liquid outlet of the separation tank for splitting the liquid from the separation tank into a process stream and a return stream.

10. The liquefaction plant of claim 9, further comprising a pump for pumping the process stream from the second splitter to the storage tank.

11. The liquefaction plant of claim 10, further comprising a pump for pumping the return stream from the second splitter.

12. The liquefaction plant of claim 9, further comprising a pump for pumping the liquid from the separation tank to the second splitter.

13. The liquefaction plant of claim 12, further comprising a valve for regulating the pressure of the process stream from the second splitter to the storage tank.

14. The liquefaction plant of claim 2, further comprising:
- a third compressor connected to an outlet of the first mixer;
- an ambient heat exchanger connected to the third compressor and the first splitter; and
- an ambient heat exchanger connected to an outlet of the expander.

15. The liquefaction plant of claim 1, further comprising:
- another compressor for receiving the gas stream from the first mixer, compressing the gas stream and delivering the gas stream to the first splitter.

16. A method of liquefying natural gas from a source of gas using a liquefaction plant having an inlet for gas, the method comprising:
- flowing gas from the source of gas through the inlet and into a first mixer;
- splitting a gas stream from the first mixer using a first splitter into a cooling stream and a process stream;
- compressing the cooling stream using a compressor;
- expanding the compressed cooling stream using an expander;
- cooling the process stream with a heat exchanger;
- separating vapor from liquid gas of the process stream in a separation chamber;
- storing the liquid gas in a storage tank;
- flowing vapor from the separation chamber and vapor from the storage tank into the first mixer to mix with gas from the source of gas;
- forming gas from liquid gas in the separation vessel using the heat exchanger; and
- flowing gas from the heat exchanger to the first mixer to mix with gas from the source of gas.

17. The method of claim 16, further comprising:
- expanding the process stream after cooling thereof with the heat exchanger using an expansion valve.

18. The method of claim 16, further comprising:
- pressurizing the liquid gas from the separation chamber to flow through the heat exchanger to the first mixer.

19. The method of claim 16, further comprising:
- pumping the liquid gas from the separation chamber to the storage tank.

20. The method of claim 16, wherein flowing vapor from the separation chamber and vapor from the storage tank into the first mixer to mix with gas from the source of gas comprises flowing the vapor from the separation chamber and the vapor from the storage vessel using at least one compressor.

21. The method of claim 16, further comprising:
- compressing the gas stream from the first mixer prior to splitting the gas stream with the first splitter.

22. A method of liquefying gas from a source of gas using a liquefaction plant having an inlet for gas, the method comprising:

flowing gas from the source of gas through the inlet and into a first mixer;

compressing a first stream of gas from the first mixer to produce a process stream;

splitting the process stream using a first splitter into a cooling stream and a process stream;

compressing the cooling stream using a compressor;

expanding the compressed cooling stream using an expander;

cooling the process stream in a heat exchanger;

expanding the process stream to further cool the process stream;

directing the process stream into a separation chamber to separate a liquid and a vapor of the process stream;

storing the liquid in a storage vessel;

flowing the vapor from the separation chamber and a vapor from the storage vessel into the first mixer to mix with gas from the source of gas;

vaporizing a portion of the liquid from the separation chamber using the heat exchanger; and flowing gas from the heat exchanger to the first mixer to mix with gas from the source of gas.

* * * * *